United States Patent [19]

Terwilliger

[11] Patent Number: 4,955,796

[45] Date of Patent: Sep. 11, 1990

[54] REFRIGERANT GAS COMPRESSOR CONSTRUCTION

[75] Inventor: Gerald L. Terwilliger, Bristol, Va.

[73] Assignee: Bristol Compressors, Inc., Bristol, Va.

[21] Appl. No.: 247,395

[22] Filed: Sep. 21, 1988

[51] Int. Cl.[5] ..... F04B 39/08

[52] U.S. Cl. ..... 417/547; 417/550; 417/552

[58] Field of Search ..... 417/547, 550, 552, 566; 251/357

[56] References Cited

U.S. PATENT DOCUMENTS

| | | | |
|---|---|---|---|
| T 946,012 | 5/1975 | Willis | 417/550 |
| 1,661,266 | 3/1928 | Parshall | 417/552 |
| 1,663,737 | 3/1928 | Thompson | 417/552 |
| 2,193,243 | 3/1940 | Teeter | 417/550 |
| 2,506,751 | 5/1950 | Trask | 417/550 |
| 2,622,792 | 12/1952 | Ramclow | 417/550 |
| 2,920,861 | 1/1960 | Hartmann | 251/357 |
| 4,408,745 | 10/1983 | Swier et al. | 251/357 |
| 4,531,532 | 7/1985 | Zimmerly | 251/357 X |

FOREIGN PATENT DOCUMENTS

| | | | |
|---|---|---|---|
| 0272229 | 6/1988 | European Pat. Off. | 417/552 |

*Primary Examiner*—Michael Koczo

*Assistant Examiner*—Eugene L. Szczecina, Jr.

[57] ABSTRACT

Refrigerant compressor construction having a cylinder, a piston mounted for reciprocation in the cylinder, a cylinder head mounted over the end of the cylinder to provide a compression chamber, and refrigerant discharge valving in the cylinder head or a valve plate assembled thereto adapted to open a discharge passage for pressurized refrigerant on the compression stroke of the piston means and to close the discharge passage on the suction stroke of the piston, a first suction gas inlet passage through the wall of the cylinder at a position remote from the cylinder head, a second suction gas inlet passage in the piston extending through the outer wall thereof and in continuous communication with the first passage, a suction gas port in the top of the piston in communication with the second passage, the port having a valve seat formed in the top of the piston and a valve disc mounted on the top of the piston for limited axial, floating movement and having a sealing surface adapted to bear against the valve seat on the compression stroke of the piston to close the second passage from the compression chamber, the floating movement being sufficient for movement of the sealing surface away from the valve seat to provide the suction gas port with suitable open dimensions to allow adequate low-pressure refrigerant gas glow into the compression chamber during the suction stroke of the piston.

17 Claims, 2 Drawing Sheets

REFRIGERANT GAS COMPRESSOR CONSTRUCTION

This invention concerns gas compressor construction having utility for compressing any gas, and having special utility for compressors fo the type employed for refrigeration or air-conditioing systems including heat pumps, wherein the compressor is electrically or mechanically powered as in automotive air conditioning systems, and wherein the compressor can be hermetically sealed, semi-hermetically sealed or open, and particularly concerns novel structural suction gas intake and discharge passage and valve design which afford substantialy improvements in compressor operating characteristics including capacity and efficiency.

Such compressors are employed, for example, in closed-loop, central air conditioning or heating units, in window unit air conditioners or heating units, and in refrigeration units, are required to provide highly compressed refrigerant gas in a thermodynamically efficient manner which becomes quite difficult when load requirements increase the temperature of the compression system and effect a diminution in density of the suction gas being feed to and contained in the compression chamber. Also, it is desirable to keep the size and weight of such compressors to a minimum while enginerring the unit to provide as much capacity and efficiency of operation as possible. such engineering must take into consideration many factors in addition to that mentioned above, from both a structural and operational standpoint including inertia within the system, operating temperatures, resistance of damage by liquid refrigerant slugging, fatigue of metal or other parts through overflexing and the like, compressor and other noise sources, and capacity of gas flow passages.

The present invention has as its principal and general objects therefore, to provide a refrigerant gas compressor, the suction side of which is so constructed as to maintain a higher suction hsa density than has heretofore been possible in equivalent equipment, and to thereby and by other structural innovations hereinafter described in detail, improve the overall operating capacity and efficiency of the compressor in a reliable and low cost manner.

These and other objects hereinafter becoming evident have been attained in accordance with the present invention which is defined in the context of a compressor assembly and with particular referenced to the suction side thereof, as a refrigerant compressor having cylinder means, piston means mounted for reciprocation in said cylinder means, cylinder head means mounted over the end of said cylinder means to provide a compression chamber, refrigerant discharge valve means in said cylinder head means adapted to open a discharge passage for pressurized refrigerant on the compression stroke of said piston means and to close said discharge passage on the suction stroke of said piston means, first suction gas inlet passage means through the wall of said cylinder means at a position remote from said cylinder head means, second suction gas inlet passage means in said piston means extending through the outer wall thereof and in continuous communicatgion with said first passage means, suction gas port means in the top of said piston means in communication with said second passage means, said port means comprising valve seat means formed in the top of said piston means and valve disc means mounted on the top of said piston means for limited axial, floating movement and having sealing surface means adapted to bear against said valve seat means on the compression stroke of said piston means to close said second passage means from said compression chamber, said floating movement being sufficient for movement of said sealing surface means away form said valve seat means to provide said suction gas port means with suitable open dimensions to allow adequate low-pressure refrigerant gas flow into said compression chamber during the suction stroke of said piston means.

In supplementary manner and as described in detail below, further innovations in the structure of the compressed gas discharge porting and in the novel physical relationship of the above piston means to this discharge porting at the apex of the compression stroke markedly contribute to maximization of the compressor efficiency and to the full realization of the above objectives. The present invention is useful for single or multicylinder compressors having a wide variety of structural designs and configurations.

Heretofore, cylinder wall porting of suction gas has been employed as shown, for example, in U.S. Pat. Nos.: 2,033,437; 2,436,854; 3,490,683; and 3,915,597, however, due either to the configuration or placement of the porting, or to the type and complexity of suction valving employed, less than maximum thermodynamic efficiency and compressor capacity has been achieved through their use. It is noted that the U.S. Pat. No. 3,490,683 patent alludes to the desirablility of cooler suction gas and adequate suction gas inlet flow, however, as is apparent from the principal inlet flow pattern adjacent to the hot cylinder head, the resistance of the spring closed inlet valve discs to inlet gas flow, and the limite volumetric capacity of the inlet passages, the structure proposed in this patent presents many operational deficiencies.

The invention int its broad aspects and in its preferred embodiment will be further understood from the following description and drawings wherein.

Figure 1:
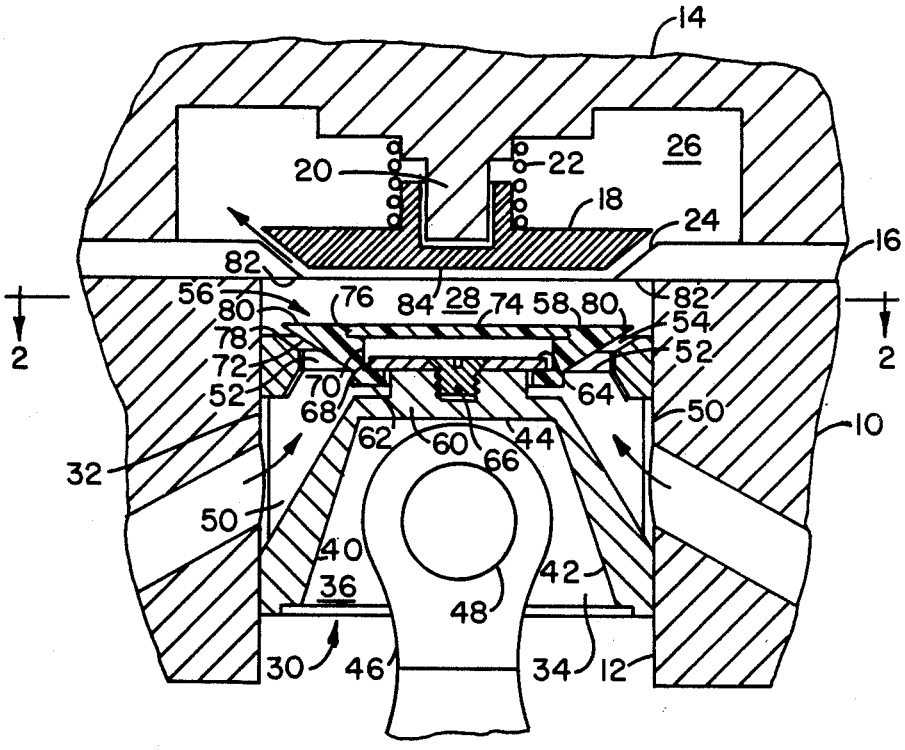
FIG. 1 is a cross-sectional side view of the relevant portions of refrigerant compressor enbodying the present invention.

Referring to the drawings, portions of a refrigerant compressor are shown comprising cylinder block 10 having a bore 12 formed therein in conventional fashion, a cylinder head 14, and a discharge portion plate 16 sandwiched and gasketed between the head and block. A discharge valve 18 is axially slidably mounted on stud 20 of the head and continually urged by spring 22 toward seat 24 formed in porting plate 16 to isolate, in cooperation with the pressure differential across the discharge port, the compressed gas discharge chamber 26 from compression chamber 28 during the suction stroke of the piston. It is noted that insofar as the present invention is concerned, the structure not designated as constituting part of the present invention, including certain elements of the cylinder block, cylinder head, discharge porting plate and discharge valve, and other components of the compressor and refrigeration unit and their function, may be of any conventional type such as shown, for example, in the aforementioned patents and others such as U.S. Pat. Nos.: 4,353,682; 2,863,301; 3,306,524; 3,509,907; and 4,537,566, the disclosures of which are incorporated herein by reference. For example, the drawing shows the discharge valve 18 seating in a porting plate 16, however, the vavle seat can be integrally formed with the head 14 and the porting plate thus eliminated.

With more specific reference to the present invention, the present piston generally designated 30 comprises a generally cylindrical body 32 formed with a cavity such as shown as 34 and defined by straight walls 36, 38, tapered walls 40, 42, and roof 44, for accommodating the connecting rod 46 and wrist pin 48 combination which pivotally connects the piston to the crankshaft in conventional manner. It is of course apparent that any conventional cavity configuration and connecting rodwrist pin combination can be employed for the present novel piston.

Figure 6:
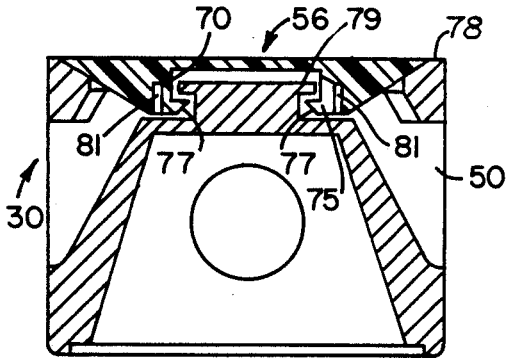
FIG. 6 is a cross-sectional view of the piston showing an alternative suction valve disc construction.
Figure 7:
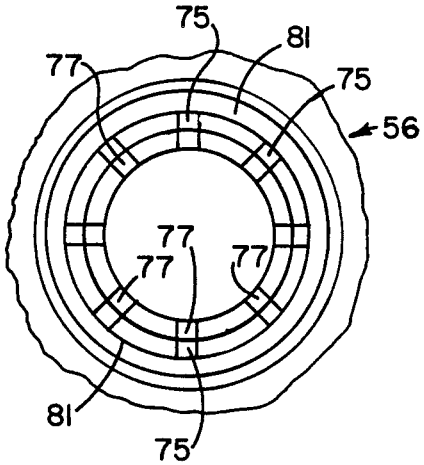
FIG. 7 is an enlarged view of the valve disc of FIGS. 1 and 6 viewed from the bottom (suction side).

Referring further to the drawings, the present piston is provided with gas passage means which, in the embodiment shown, comprises a pair of large apertures 50 cut through the outer wall of the piston body on opposite sides thereof and extending inwardly and upwardly and adjacent to annular valve seat 54. The valve disc generally designated 56, in the embodiment shown, is as aforesaid, mounted on the top of the piston for limited axial motion which is a floating motion unhindered by any structural restraints. The disc is preferably of a strong, fairly inflexible plastic material capable of withstanding operating temperatures and pressures and includes such polymers as the "Vespel" and others disclosed in columns 3 and 4 of U.S. Pat. No. 4,368,755, or can be metallic or ceramic or combinations thereof. The manner in which the disc is floatingly secured to the piston may be greatly varied, and the technique used in the exemplary drawing, although quite effective, is only exemplary. The valve disc and the valve seat 54 provide the suction gas port means. For reasons hereinafter discussed in some detail, the upper surface 58 of the disc is preferably flat. In the exemplary embodiment shown, the top of the piston is formed to provide a circular shaft-like projection 60 over and around which an annular attachment flange 62 of the disc is loosely mounted. Other shaft-like shapes such as square or the like may also be employed. Retaining means which is shown for exemplary purposes as a flat circular plate 64 secured to projection 60 by machine screw 66 or equivalent mechanical means, is adapted to about the upper surface of flange 62 to prevent complete axial removal from the piston, and the periphery 68 of plate 64 is adapted to abut the inner wall 70 of the valve disc to prevent radial displacement thereof and thus insure proper seating of the annular sealing surface 72 of the valve disc on the valve seat 54 on the compression stroke. In this particular structure of the valve disc a circular access cover 74 is provided to complete the planar upper surface of the disc. This cover, which is affixed to the disc body by any suitable means such as threads 76, screws, plastic welding (solvent gluing), and any combination of these or other convenient means, allows the disc to be readily molded substantially as a monolith and assembled on the piston. It is noted that the access cover 74 may also be of plastic coated steel or the like should any excessive flexing of the plastic material alone occur and present a problem. In a preferred embodiment as shown in FIG. 6, the valve disc 56 is a single molded piece provided on its lower side with a plurality of fingers 75 circumferentially spaced around the cavity formed by inner wall 70, said fingers preferably having beveled leading edges 77 for camming over the periphery of the retaining projection 79 preferably integrally formed on the piston. An annular slot 81 formed in the bottom of the disc adjacent the radially outer edges of the fingers allows the fingers to flex radially outwardly as the disc is pushed or snapped over the projection 79. A typical number of fingers for the size disc as shown is from about four to about sixteen. The flexible fingers alternatively may be provided on the peripheral portionsof the retaining projection to provide equivalent snap-on capability, in which case, a member of suitable flexible material, e.g., plastic, can be secured to the top of the retaining projection to provide the flexible fingers operating in an up-side-down manner relative to the finger structure shown.

It is particularly emphasized here that in order for the effectiveness of the present invention to be realized to its maximum, the upper surface of the valve disc including the access plate should be essentailly flat and lie in a single plane with the upper surface 78 of the piston when the valve disc is seated during the compression stroke. This construction allows the top surface 78 of the piston and the radially outer portions 80 of the valve disc to be positioned immediately adjacent the annular inner surface 82 of the porting plate 16 such that the bottom surface 84 of the discharge valve 18, which is preferably shaped such that its surface 84 and porting plate surface 82 can lie in a single plane, lies immediately adjacent the upper surface 58 of the valve disc at the apex of the compression stroke. At this point the preference for the plastic material for the valve disc and also for the discharge valve, and for their construction as shown is emphasized for the reasons that (1) their construction and light-weight allows them to open and close with greatly reduced inertia, i.e., requiring very little energy, (2) contact of the valves with their metal seats and with each other produces little noise, (3) the closing force exerted by spring 22 can be very light since the total evacuation of the pressurized refrigerant from chamber 28 essentially eliminates any dynamic pressure drop across the discharge port which the spring would have to overcome, (4) liquid slugging would have little if any tendency to damage the valves such as can easily occur with metal reed and other types of flex valving, (5) the essentially total discharge of compressed gases eliminates energy loss through refrigerant reexpansion on the suction stroke, and (6) the extraordinarily capacious inlet and discharge porting provided by this unique construction greatly reduces the energy required to move the desired volumes of refrigerant through the system.

As stated above, various configurations and shapes of the structural components of the present invention may be varied, e.g., the piston, cylinder, valve discs and the like may be of any configuration known to the art such as oval, square, rectangular or the like, however the shapes shown herein are preferred.

The invention has been described in detail with particular reference to preferred embodiments thereof, but it will be understood that variations and modifications will be effected within the spirit and scope of the invention.

I claim:

1. In a refrigerant compressor having cylinder means, piston means mounted for reciprocation in said cylinder means and having a substantially planar top, cylinder head means mounted over the end of said cylinder means to provide a compression chamber, and refrigerant discharge valve means in said cylinder head means adapted to open a discharge passage for pressurized refrigerant on the compression stroke of said piston means and to close said discharge passage on the suction stroke of said piston means, first suction gas inlet passage means through the wall of said cylinder means at a position remote from said cylinder head means, second suction gas inlet passage means in said piston means extending through the outer wall thereof and in communication with said first passage means over at least a substantial portion of the travel of said piston means, suction gas port means through the top of said piston means and adapted for communication with said second passage means, said port means comprising a substantially circular aperture encompassing a major area of the top of said piston and surrounded and defined by a substantially annular, beveled valve seat means, a substantially circular, beveled outer periphery, substantially planar top, valve disc means mounted on the top of said piston means for limited axial, essentially frictionless floating movement, the beveled surfaces of said valve seat means and of said valve disc means being adapted to form a fluid seal on the compression stroke of said piston means to close off said second passage means from said compression chamber, said floating movement of said valve disc means functioning to provide said suction gas port means with suitable open dimensions to allow a high volume flow of low-pressure refrigerant gas into said compression chamber during the suction stroke of said piston means, said valve seat means and said valve disc means being dimensioned to allow the top of said piston means and the top of said valve disc means to lie in substantially the same plane on the compression stroke.

2. the compressor of claim 1 wherein said valve disc means is of light-weight plastic material.

3. The compressor of claim 1 wherein the ratio of the maximum volume of said compression chamber on the suction stroke to the area of said suction gas port means in its full open condition is from about 1.5 to about 8.0.

4. The compressor of claim 3 wherein the said ratio is from about 3.5 to about 6.5.

5. The compressor of claim 1 wherein multiple valve disc means and valve seat means are provided.

6. The unit of claim 1 wherein said valve disc means is of light-weight plastic material.

7. The unit of claim 1 wherein multiple suction gas port means are provided in said body.

8. The unit of claim 1 wherein the only significant pressure contact of said valve disc means with the piston unit during the reciprocating cycle is with the valve seat means during the compression stroke.

9. The unit of claim 1 wherein the top of the piston body and valve disc means lie essentially in the same plane when the valve head means is in its closed position.

10. The compressor of claim 1 wherein the first suction gas inlet passage means is open to the suction gas port in the piston means immediately after the piston starts its suction stroke and thereafter until the piston means starts its compression stroke.

11. The unit of claim 1 wherein the first suction gas inlet passage means is sufficiently remote from said cylinder head means to be essentially uninfluenced directly by the temperature of refrigerant therein.

12. The unit of claim 1 wherein said discharge valve means and said suction valve disc means lie in substantially the same contiguous plane at the apex of the compression stroke such that essentially all gas in the compression chamber is exhausted therefrom through said discharge valve means.

13. The unit of claim 12 wherein said discharge valve means and said suction valve disc means are of plastic material.

14. The compressor of claim 1 wherein said valve disc means is provided with a plurality of flexible fingers for snapping over retaining means on the top of said piston means to movably secure said valve disc means to said piston means.

15. The compressor of claim 1 wherein retaining means on the top of said piston means is provided with a plurality of flexible fingers for snapping over portions of said valve disc means to movably secure said valve disc means to said piston means.

16. The compressor of claim 1 wherein said discharge valve means comprises (1) a substantially annular beveled seating surface extending through the surface of said cylinder head means communicating with said compression chamber with said seating surface facing into the discharge passage, and (2) discharge valve disc means reciprocably mounted in said discharge passage and having a substantially annular beveled seating surface, said seating surfaces adapted to mate to form a seal between said compression chamber and said discharge passage on the suctioin stroke of said piston means, said discharge valve disc means having a planar inner surface in communication with said compression chamber and lying in a plane essentially parallel to the plane in which the top of the suction valve disc means lies, said inner surface of said discharge valve disc means and said top of said suction valve disc means being adapted to become relatively positioned substantially in the same plane at the beginning of the suction stroke such taht essentially all of the compressed gas is transferred to the discharge passage.

17. A valve-in-piston unit for use in a refrigerant compressor wherein first suction gas inlet passage means is provided through the compressor cylinder wall remote from the compressor cylinder head, said unit comprising a generally cylindrical piston body having a substantially planar top surface, suction gas port means provided by annular suction valve seat means formed through a major area said top surface of said body and by suction valve disc means mounted on top portions of said body for limited axial, essentially frictionless, free floating movement toward and away from said seat means and having beveled sealing surface means adapted to seal to seal gainst beveled sealing surface means of said seat means on the compression stroke of the piston and to lift off of said seat means on the suction stroke of the piston, and second suction gas passage means in said body communicating with said suction gas port means and extending through the side of said body for communication with said first passage means through the cylinder wall.

* * * * *

UNITED STATES PATENT AND TRADEMARK OFFICE

CERTIFICATE OF CORRECTION

PATENT NO. : 4,955,796

DATED : 09/11/90

INVENTOR(S) : Terwilliger, Gerald L.

It is certified that error appears in the above-identified patent and that said Letters Patent is hereby corrected as shown below:

Title page, in ABSTRACT, next to last line, the word "glow" should be ---flow---.

Figure 5:
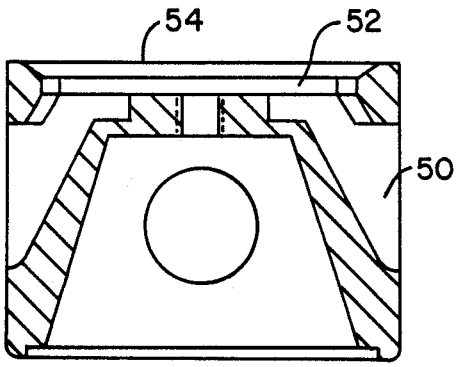
FIG. 5 is a view of the piston as in FIG. 1 with the valve disc retainer removed for clarity.
Figure 3:
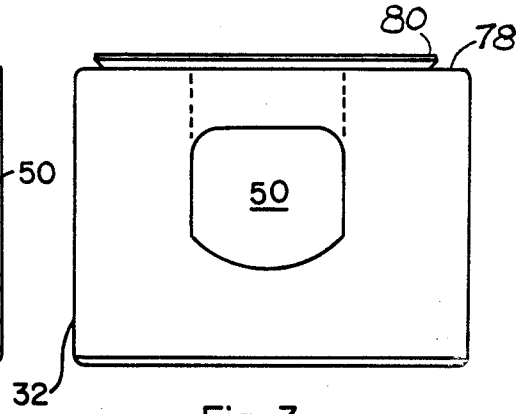
FIG. 3 is a side elevational view of the piston construction of FIG. 2 rotated 90° with the valve disc in its open position.
Figure 2:
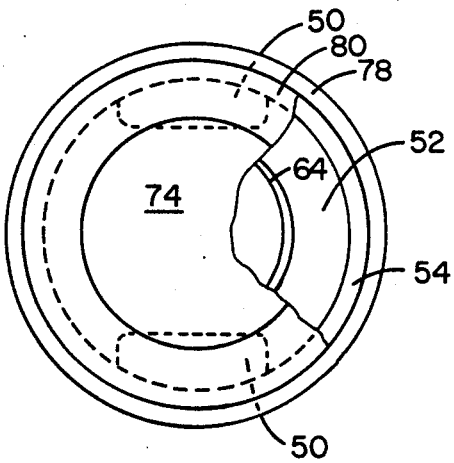
FIG. 2 is a view taken along line 2—2 of FIG. 1 in the direction of the arrows with a portion of the valve disc removed.
Figure 4:
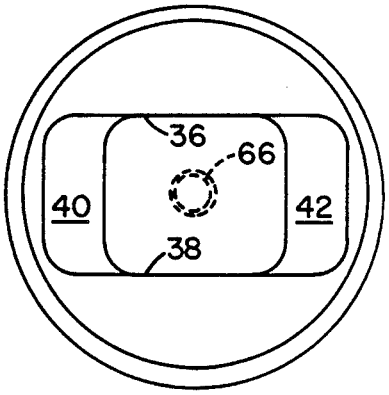
FIG. 4 is a view looking into the piston from the bottom.

Column 1, line 7, "fo" should be ---of---.
Column 1, line 15, "substantialy" should be ---substantial---.
Column 1, line 29, "such" should be ---Such---.
Column 1, line 40, "hsa"should be ---gas---.
Column 1, line 49, "referenced" should be ---reference---.
Column 1, lines 63, 64, "communicatgion" should be ---communication---.
Column 2, line 29, "U.S. Pat. No." should be deleted.
Column 2, line 35, "limite" should be ---limited---.
Column 2, line 38, "int" should be ---in---.
Column 2, line 51, "and" should be deleted, and "Fig. 5"(etc") placed in paragraph form.
Column 2, line 52, the word "and" should be inserted after "disc"
Column 3, line 12, "vavle" should be ---valve---.
Column 3, line 24, "rodwrist" should be ---rod-wrist---.
Column 3, line 55, "about" should be ---abut---.
Column 4, line 27, "essentailly" should be ---essentially---.

Column 6,
Claims 6-9 depend from claim 17 of Patent, rather than from claim 1.
Claim 16, line 38, "suctioin" should be ---suction---.
Claim 17, line 56, the word "of" should be inserted after "area".
Claim 17, line 61, delete "to seal" second occurrence.
Claim 17, line 61, "gainst" should be ---against---.

UNITED STATES PATENT AND TRADEMARK OFFICE

CERTIFICATE OF CORRECTION

PATENT NO. :4,955,796

DATED :09/11/90

INVENTOR(S) :Terwilliger, Gerald

It is certified that error appears in the above-identified patent and that said Letters Patent is hereby corrected as shown below:

Col. 6, Claim 16, Line 47 "taht" should be ---that---.

Signed and Sealed this

Fifth Day of May, 1992

*Attest:*

*Attesting Officer*

DOUGLAS B. COMER

*Acting Commissioner of Patents and Trademarks*